United States Patent [19]

Cataldo

[11] 4,452,396

[45] Jun. 5, 1984

[54] FUEL INJECTOR

[75] Inventor: Roy S. Cataldo, Birmingham, Mich.

[73] Assignee: General Motors Corporation, Detroit, Mich.

[21] Appl. No.: 382,138

[22] Filed: May 26, 1982

[51] Int. Cl.[3] ..... F02M 61/18

[52] U.S. Cl. ..... 239/223; 239/453; 239/533.11; 239/533.12

[58] Field of Search ..... 239/223, 224, 453, 456, 239/459, 533.3, 533.7, 533.9, 533.11, 533.12

[56] References Cited

U.S. PATENT DOCUMENTS 3,933,133 1/1976 Shekleton .

4,356,978 11/1982 Krauss ..... 239/453 X 4,373,672 2/1983 Morishita et al. ..... 239/223 X

FOREIGN PATENT DOCUMENTS 1588856 4/1981 United Kingdom .

*Primary Examiner*—Andres Kashnikow

*Attorney, Agent, or Firm*—C. K. Veenstra

[57] ABSTRACT

The injection valve in a diesel engine fuel injector directs fuel onto the surface of a spinning disc which is effective to disperse the fuel into a finely divided spray of substantially uniformly sized fuel droplets. The disc is mounted on a shaft driven by an air turbine rotor and supported by air bearings.

5 Claims, 1 Drawing Figure

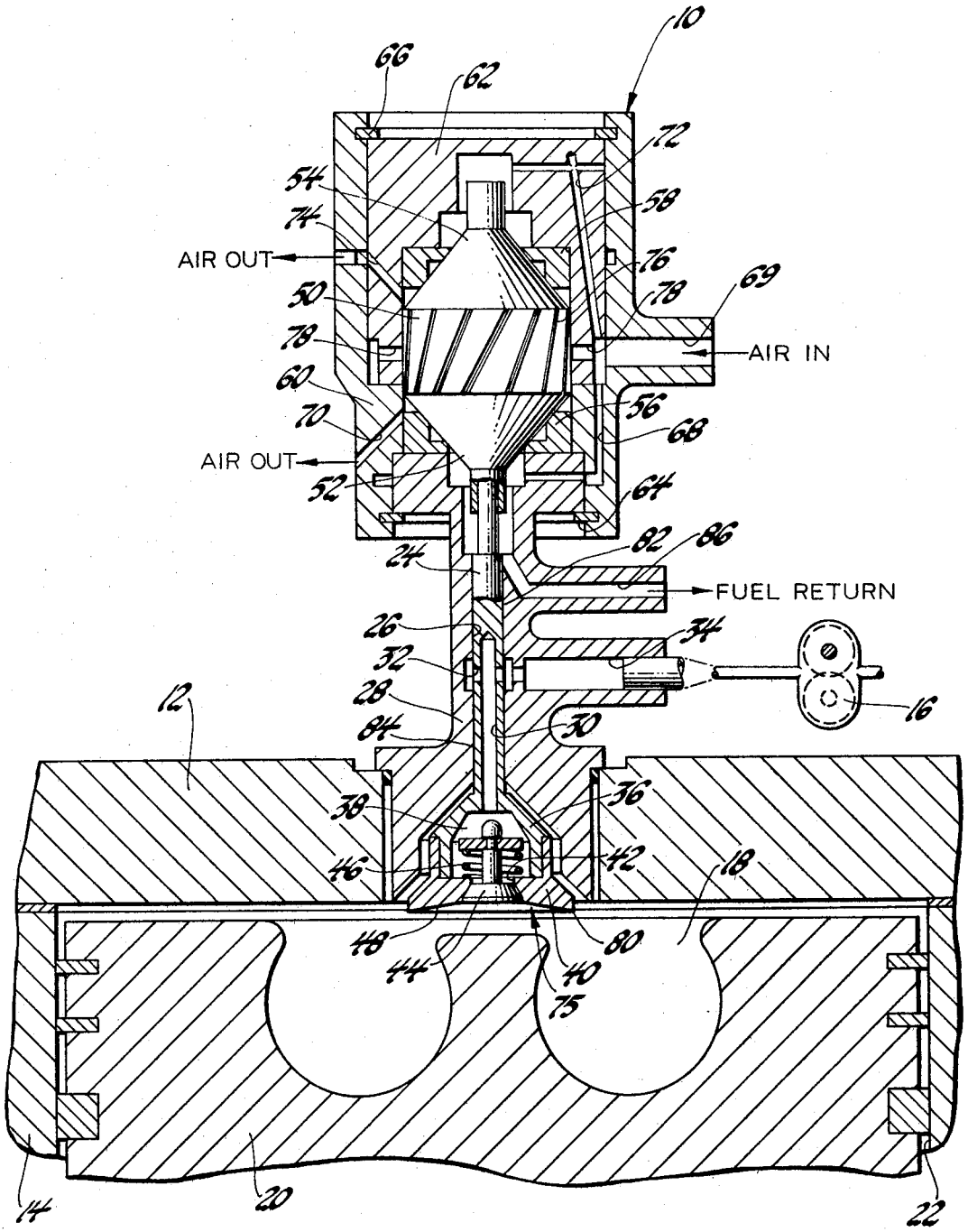
10
66
62
72
54
58
74
AIR OUT
76
69
50
78
78
AIR IN
60
56
70
68
AIR OUT
52
64
82
86
24
FUEL RETURN
26
34
32
28
16
12
84
30
38
36
46
42
18
48
80
44
40
75
14
20
22

FUEL INJECTOR

TECHNICAL FIELD

This invention relates to an injector for providing a finely divided spray of substantially uniformly sized fuel droplets which is particularly desirable for combustion in a compression ignition engine.

SUMMARY OF THE INVENTION

Observations of the burning of fuel employed in compression ignition engines suggest that the formation and emission of soot or particulates can be inhibited if the fuel is delivered in a finely divided spray of droplets having a substantially uniform size in the range from about 10 to about 30 microns. This invention provides an injector for delivering a fuel spray of that nature.

A fuel injector according to this invention has a hollow shaft ending in a cupped portion which receives fuel through the hollow shaft. The cupped portion is closed by a disc containing a central fuel delivery orifice, and an injection valve mounted on the disc is biased to obstruct fuel flow through the orifice. The shaft has a rotor which spins the shaft, disc and valve at high speeds. When the engine fuel injection pump delivers fuel to the injector, the valve permits fuel flow from the cupped portion through the orifice and onto the outer surface of the spinning disc, and fuel centrifuged from the edge of the spinning disc forms a finely divided spray of substantially uniformly sized fuel droplets.

Tests have shown that fuel droplets in the desired range from about 10 to 30 microns are produced when a disc having a 2 cm diameter is spun at a speed in excess of 70,000 rpm. The desired fuel droplet size also has been achieved at lower speeds, and it is believed that such droplets will be formed when the disc is spun at a speed providing a velocity at the edge of the disc of at least about 400,000 cm per second.

To permit operation at such speeds, the preferred embodiment has an air bearing which supports the shaft while minimizing the frictional resistance to rotation. In addition, the preferred embodiment employs an air driven turbine rotor to spin the rotating assembly at high speed.

It will be appreciated that this fuel injector may be employed to deliver fuel to the variable volume combustion chamber of an air compressing spark ignition engine as well as to the variable volume combustion chamber of an air compressing compression ignition engine. Initially, however, its advantage may be enjoyed by a compression ignition engine in view of the concern over emission of particulates by such engines.

The details as well as other features and advantages of the preferred embodiment are set forth in the remainder of the specification and are shown in the accompanying drawing.

SUMMARY OF THE INVENTION

The sole FIGURE of the drawing is a sectional view of a preferred embodiment of this fuel injector, schematically showing the injector mounted to deliver fuel to an engine combustion chamber.

THE PREFERRED EMBODIMENT

Referring to the drawing, a fuel injector 10 is mounted in the head 12 of an air compressing internal combustion engine 14. Injector 10 delivers fuel from an injection pump 16 to a variable volume combustion chamber 18 formed between head 12 and a piston 20 which reciprocates in a cylinder 22.

Injector 10 has a shaft 24 supported in a bore 26 of a lower injector housing 28. One end of shaft 24 is hollow to define a fuel passage 30 having lateral ports 32 which receive fuel from injection pump 16 through an inlet 34 in housing 28.

The lower end of shaft 24 has a cup 36 defining a fuel chamber 38 which receives fuel from passage 30. Chamber 38 is closed by a disc 40 secured to cup 36. A central fuel delivery orifice 42 opens through disc 40 from fuel chamber 38 and is controlled by a small injection valve 44. A spring 46 biases valve 44 to obstruct fuel flow through orifice 42; however, when injection pump 16 delivers fuel to injector 10, valve 44 is displaced from orifice 42 and directs fuel flowing from chamber 38 through orifice 42 onto the outer surface 48 of disc 40.

The upper end of shaft 24 is secured to a turbine rotor 50. Rotor 50 has lower and upper tapered bearing surfaces 52 and 54 which are embraced by air bearing cups 56 and 58. Air bearing cups 56 and 58 are mounted within an upper injector housing formed by a housing sleeve 60 and a housing insert 62. In the embodiment of injector 10 shown in the drawing, housing sleeve 60 is secured to lower housing 28 by a retaining ring 64 while housing sleeve 60 and insert 62 are secured together by a retaining ring 66.

Air is supplied between lower tapered bearing surface 52 and lower bearing cup 56 by an air passage 68 extending from a fitting 69 through sleeve 60 and lower housing 28; air is exhausted from bearing cup 56 through a passage 70 in sleeve 60. Similarly, air is supplied between upper tapered bearing surface 54 and upper bearing cup 58 from fitting 69 through a passage 72 formed in insert 62 and is exhausted through a passage 74 formed in insert 62 and sleeve 60. This construction provides an air bearing which supports rotor 50 and the rotating assembly 75 formed by shaft 24, cup 36, disc 40 and valve 44 while minimizing their resistance to rotation or spinning.

The central land 76 of rotor 50 is formed with a plurality of flutes which receive air from fitting 69 through tangentially directed holes 78 formed in insert 62. Rotor 50 spins as air is supplied through holes 78, and its rotational speed increases as the air pressure in fitting 69 is increased. It is suggested that a rotor land 76 with a length of approximately $\frac{3}{8}$ inch and a diameter of approximately 13/16 inch have fifteen peripherally spaced curvilinear flutes formed by a $\frac{3}{8}$ inch miller the axis of which is perpendicular to the axis of rotor 50 and offset by approximately $\frac{1}{4}$ inch; the miller is moved axially as rotor 50 is turned slightly to produce the curvilinear flutes. It is also suggested that insert 62 have eight peripherally spaced holes formed by a number 70 drill and directed tangentially to rotor 50. With this construction, air supplied to a fitting 69 at a pressure of about 30 psi will spin rotor 50 and rotating assembly 75 at a speed of approximately 70,000 rpm. Increasing the air pressure will increase the rotational speed, and decreasing the air pressure will decrease the rotational speed. Air delivered through the flutes on land 76 will be exhausted through passages 70 and 74.

Thus as air is supplied through holes 78, rotor 50 spins the rotating assembly 75 formed by shaft 24, cup 36, disc 40 and valve 44. Valve 44 opens as injection pump 16 delivers fuel to injector 10, and fuel flows from chamber 38 through orifice 42 and is directed by valve 44 onto the outer surface 48 of disc 40. The fuel on outer surface 48 is centrifuged from the edge 80 of disc 40 to form a finely divided spray of substantially uniformly sized fuel droplets. It has been found that when a disc has a diameter of approximately 2 cm and a speed of about 70,000 rpm, the size of the fuel droplets centrifuged from the edge of the disc falls in the range from about 10 to about 30 microns.

In some embodiments it may be necessary to increase the speed to as much as 100,000 rpm to achieve the desired fuel droplet size. It is believed that it is necessary to provide a velocity at the edge 80 of disc 40 of at least about 400,000 cm per second to produce fuel droplets in the range from about 10 to about 30 microns.

Rotating assembly 75 is spun continually by rotor 50 during operation of engine 14, and fuel is supplied by injection pump 16 periodically at the appropriate time in the cycle of events in combustion chamber 18. In some applications it may be desired to accelerate rotating assembly 75 during the first portion of the injection event to provide smaller fuel droplets for initial combustion and then to permit assembly 75 to decelerate and provide slightly larger fuel droplets toward the end of the combustion event. This may be accomplished by increasing the air pressure at fitting 69 at the start of the injection event and then decreasing the air pressure as the injection event continues.

Shaft 24 has a lap fit in bore 26, and the slight fuel flow between shaft 24 and bore 26 creates oil glands 82 and 84 above and below inlet 34. Oil glands 82 and 84 provide a low friction bearing about shaft 24. Upper oil gland 82 also seals injection pump pressure from air supply pressure, while lower oil gland 84 seals combustion chamber pressure from injection pump pressure. Any fuel leaking downwardly through lower oil gland 84 will be centrifuged off the back of disc 40. Any fuel leaking upwardly through upper oil gland 82 will be vented through a return fitting 86.

It will be appreciated that this injector disperses the fuel by centrifuging the fuel from the edge 80 of disc 40. Thus it is important that valve 44 direct fuel flowing from chamber 38 through orifice 42 onto the surface 48 of disc 40, and injection pump 16 should supply fuel to injector 10 at a pressure only slightly above the pressure in combustion chamber 18. If the pressure provided by injection pump 16 substantially exceeds the pressure in combustion chamber 18, a substantial portion of the fuel admitted past valve 44 may not flow onto disc surface 48 and injector 10 then would not provide a finely divided spray of uniformly sized fuel droplets in the 10–30 micron range.

The embodiments of the invention in which an exclusive property or privilege is claimed are defined as follows:

1. An injector for delivering fuel from an injection pump to a variable volume combustion chamber in an air compressing internal combustion engine, said injector comprising a housing having a fuel inlet for periodically receiving fuel from said injection pump, a rotatable assembly including a hollow shaft supported in said housing and defining an axially extending fuel passage having a port for receiving fuel from said housing fuel inlet, one end of said shaft having a cupped portion defining a fuel chamber receiving fuel from said passage, said cupped portion having a disc closing said chamber, said disc having a central fuel orifice, and a valve mounted in said chamber and biased to obstruct fuel flow through said orifice, said valve being adapted to permit fuel flow from said chamber through said orifice and onto the outer surface of said disc as said inlet receives fuel from said pump, and means connected to the other end of said shaft for continually spinning said rotatable assembly at a speed effective to disperse fuel from the edge of said disc into a finely divided spray of substantially uniformly sized fuel droplets.

2. An injector for delivering fuel from an injection pump to a variable volume combustion chamber in an air compressing internal combustion engine, said injector comprising a housing having a fuel inlet for periodically receiving fuel from said injection pump, a rotatable assembly including a hollow shaft supported in said housing and defining an axially extending fuel passage having a port for receiving fuel from said housing fuel inlet, one end of said shaft having a cupped portion defining a fuel chamber receiving fuel from said passage, said cupped portion having a disc closing said chamber, said disc having a central fuel orifice, and a valve mounted in said chamber and biased to obstruct fuel flow through said orifice, said valve being adapted to permit fuel flow from said chamber through said orifice and onto the outer surface of said disc as said inlet receives fuel from said pump, and means connected to the other end of said shaft for spinning said rotatable assembly at a speed effective to disperse fuel from the edge of said disc into a finely divided spray of fuel droplets having a substantially uniform size in the range from about 10 to about 30 microns.

3. An injector for delivering fuel from an injection pump to a variable volume combustion chamber in an air compressing internal combustion engine, said injector comprising a housing having a fuel inlet for periodically receiving fuel from said injection pump, a rotatable assembly including a hollow shaft supported in said housing and defining an axially extending fuel passage having a port for receiving fuel from said housing fuel inlet, one end of said shaft having a cupped portion defining a fuel chamber receiving fuel from said passage, said cupped portion having a disc closing said chamber, said disc having a central fuel orifice, and a valve mounted in said chamber and biased to obstruct fuel flow through said orifice, said valve being adapted to permit fuel flow from said chamber through said orifice and onto the outer surface of said disc as said inlet receives fuel from said pump, and means connected to the other end of said shaft for spinning said rotatable assembly at a speed providing a velocity at the edge of said disc of at least about 400,000 cm/sec to thereby disperse fuel from the edge of said disc into a finely divided spray of fuel droplets having a substantially uniform size in the range from about 10 to 30 microns.

4. An injector for delivering fuel from an injection pump to a variable volume combustion chamber in an air compressing internal combustion engine, said injector comprising a housing having a fuel inlet for periodically receiving fuel from said injection pump, a rotatable assembly including a hollow shaft disposed in said housing and defining an axially extending fuel passage having a port for receiving fuel from said housing fuel inlet, one end of said shaft having a cupped portion defining a fuel chamber receiving fuel from said passage, said cupped portion having a disc closing said chamber, said disc having a central fuel orifice, and a valve mounted in said chamber and biased to obstruct fuel flow through said orifice, said valve being adapted to permit fuel flow from said chamber through said orifice and onto the outer surface of said disc as said inlet receives fuel from said pump, and means connected to the other end of said shaft for spinning said rotatable assembly at a speed effective to disperse fuel from the edge of said disc into a finely divided spray of substantially uniformly sized fuel droplets, said spinning means including a rotor secured to said shaft, said rotor having a tapered bearing surface, said housing having an air bearing cup adjacent said bearing surface and passages for directing air to said cup to provide a low friction support for said rotor and said rotatable assembly.

5. An injector for delivering fuel from an injection pump to a variable volume combustion chamber in an air compressing internal combustion engine, said injector comprising a housing having a fuel inlet for periodically receiving fuel from said injection pump, a rotatable assembly including a hollow shaft disposed in said housing and defining an axially extending fuel passage having a port for receiving fuel from said housing fuel inlet, one end of said shaft having a cupped portion defining a fuel chamber receiving fuel from said passage, said cupped portion having a disc closing said chamber, said disc having a central fuel orifice, and a valve mounted in said chamber and biased to obstruct fuel flow through said orifice, said valve being adapted to permit fuel flow from said chamber through said orifice and onto the outer surface of said disc as said inlet receives fuel from said pump, a rotor secured to the other end of said shaft, said rotor having a tapered bearing surface, said housing having an air bearing cup adjacent said bearing surface and passages for directing air to said cup to provide a low friction support for said rotor and said rotatable assembly, and means for causing said rotor to effect continual spinning of said rotatable assembly at a speed providing a velocity at the edge of said disc of at least about 400,000 cm/sec to thereby disperse fuel from the edge of said disc into a finely divided spray of fuel droplets having a substantially uniform size in the range from about 10 to about 30 microns.

* * * * *